US006644170B2

(12) United States Patent
Thompson et al.

(10) Patent No.: US 6,644,170 B2
(45) Date of Patent: Nov. 11, 2003

(54) DOUBLE SPLINE HYDRAULIC PUMP

(75) Inventors: Lloyd E. Thompson, Peoria, IL (US); Trent A. Simpson, Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/077,138

(22) Filed: Feb. 15, 2002

(65) Prior Publication Data

US 2003/0154853 A1 Aug. 21, 2003

(51) Int. Cl.[7] ..... F01B 13/04

(52) U.S. Cl. ..... 92/57; 92/71; 91/499; 417/269; 74/60

(58) Field of Search ..... 92/12.2, 57, 71; 91/499, 504, 505, 506; 417/269; 74/60

(56) References Cited

U.S. PATENT DOCUMENTS

| | | | | |
|---|---|---|---|---|
| 2,925,046 A | * | 2/1960 | Budzich | 91/506 |
| 3,139,038 A | * | 6/1964 | Stewart | 74/60 |
| 3,241,495 A | * | 3/1966 | Diedrich et al. | 91/507 |
| 3,616,727 A | | 11/1971 | Suzuki et al. | 91/499 |
| 4,232,587 A | | 11/1980 | Kline | 91/499 |
| 4,301,716 A | | 11/1981 | Saegusa et al. | 92/71 |
| 4,793,239 A | | 12/1988 | Eickmann | 91/485 |
| 4,799,419 A | | 1/1989 | Krause | 91/499 |
| 4,950,132 A | | 8/1990 | Brian, Jr. et al. | 417/269 |
| 5,033,358 A | | 7/1991 | Molly | 91/487 |
| 5,269,193 A | | 12/1993 | Rabinow | 74/60 |
| 5,671,653 A | | 9/1997 | Martensen et al. | 92/57 |
| 5,784,949 A | * | 7/1998 | Ryken et al. | 92/57 |
| 5,916,348 A | | 6/1999 | Lanfredi | 92/71 |

FOREIGN PATENT DOCUMENTS

| | | | |
|---|---|---|---|
| JP | 60-147579 | 8/1985 | F04B/1/20 |

* cited by examiner

*Primary Examiner*—Edward K. Look
*Assistant Examiner*—Thomas E. Lazo
(74) *Attorney, Agent, or Firm*—Taylor & Aust.

(57) ABSTRACT

In a hydraulic pump assembly, an annular sleeve member is radially interposed between an outer peripheral surface portion of an input shaft and an inner peripheral surface portion of a cylinder block or barrel within which are provided a plurality of piston cylinders for accommodating a plurality of pumping pistons. The outer peripheral surface portion of the input shaft includes an outer peripheral splined section, and the inner peripheral surface portion of the cylinder block or barrel includes an inner peripheral splined section. The annular sleeve member is provided with the inner peripheral splined portion for splined engagement with the outer peripheral splined portion of the input shaft and with the outer peripheral splined portion for engagement with the inner peripheral splined portion of the cylinder block or barrel. In this manner, a dual splined interconnection system is defined between the input shaft, the annular sleeve member and the cylinder block or barrel.

8 Claims, 2 Drawing Sheets

DOUBLE SPLINE HYDRAULIC PUMP

TECHNICAL FIELD

The present invention relates generally to hydraulic pumps, and more particularly to a hydraulic pump assembly which has incorporated therein a splined insert component.

BACKGROUND

Conventional hydraulic pumps include an input or power shaft defining a splined connection with a cylinder block or barrel. Pumping pistons are reciprocatingly mounted within cylinder bores of the pump cylinder block or barrel, and the piston rods have spherical or ball-shaped end portions which are disposed within recessed portions of shoes mounted upon the pump swashplate. In accordance with a first technique conventionally employed for securing the shoes upon the pump swashplate, the flat or planar sides or surfaces of the shoes are mounted upon corresponding flat or planar surfaces of the swashplate and are retained thereon with a fixed clearance by suitable clamping mechanisms. While such hydraulic pump assemblies have, of course, exhibited satisfactory operational performance, it is sometimes difficult to attain the fixed clearance between the shoes and the swashplate in accordance with the desired or requisite manufacturing tolerances. In addition, the various components of the assemblies are also difficult or tedious to in fact assemble, and the assembly procedures are therefore costly in terms of man-hours required to be expended.

second system or technique conventionally employed for securing the shoes upon the pump swashplate is disclosed, for example, within U.S. Pat. No. 5,784,949 which issued to Ryken et al. on Jul. 28, 1998. In accordance with this system or technique, a plurality of axially extending pins are disposed within axially extending holes or bores as to in effect be interposed between the internal peripheral bore portion of a cylinder block and the external peripheral portion of a splined input shaft. Washers are forced into contact with first ends of pins by a coil spring, and the opposite ends of the pins engage a ball guide which, in turn, engages a guide member. The guide member effectively clamps or secures shoe plates or slipper retaining rings through slippers. Again, as was the case with the first conventional device or technique used for mounting and retaining the shoes upon the pump swashplate, while such hydraulic pump assemblies have of course exhibited satisfactory operational performance, the various components of the assemblies are also difficult or tedious to in fact assemble, and in addition, the pins exhibit excessive wear.

A need therefore exits in the art for a new and improved hydraulic pump assembly which effectively overcomes or eliminates the aforenoted problems or assembly disadvantages or drawbacks characteristic of the known or conventional prior art hydraulic pump swashplate and piston rod assemblies.

The present invention is directed to overcoming one or more of the problems as set forth above.

SUMMARY OF THE INVENTION

The foregoing need is achieved in accordance with the principles and teachings of the present invention through the provision of a new and improved hydraulic pump assembly which comprises a cylinder block defining an axis and having an inner peripheral splined portion; a plurality of piston cylinders defined within the cylinder block and arranged within a circumferential array about the axis of the cylinder block for respectively housing a plurality of pumping pistons; an input shaft having an axial extent and disposed substantially coaxially within the cylinder block, the input shaft having an outer peripheral splined portion; a coil spring disposed around the input shaft at a first axial position thereof; a washer disposed around the input shaft at a second axial position thereof for biasing shoe plates into engagement with swashplate shoes; and an annular sleeve member disposed around the input shaft and axially interposed between the coil spring and the washer such that the coil spring axially biases the annular sleeve member into engagement with the washer, the annular sleeve member having an inner peripheral splined portion for splined engagement with the outer peripheral splined portion of the input shaft, and an outer peripheral splined portion for splined engagement with the inner peripheral splined portion of the cylinder block.

DETAILED DESCRIPTION

Figure 1:
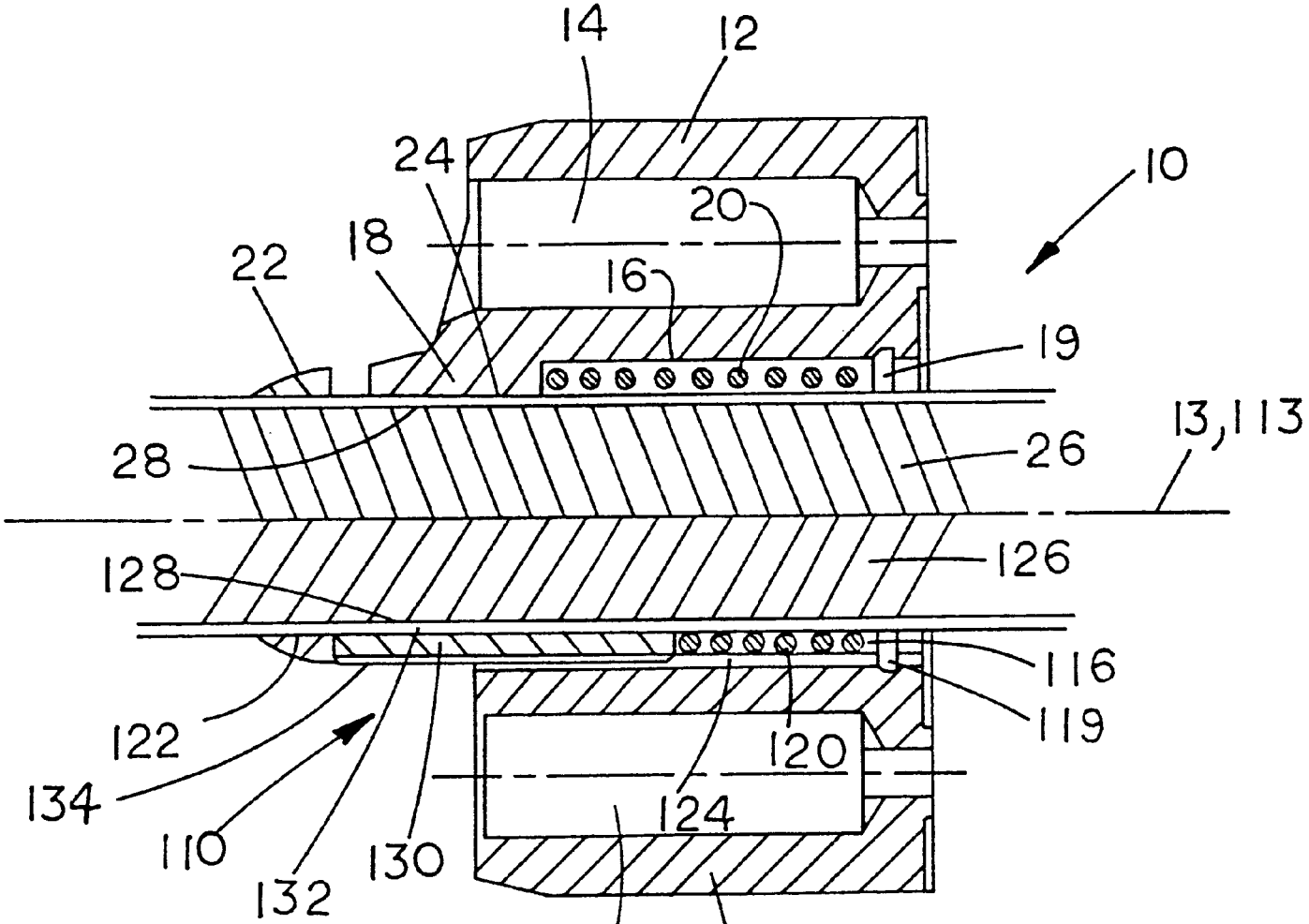
FIG. 1 is an axial, longitudinally split cross-sectional view partially showing a conventional hydraulic pump assembly as compared to a first embodiment of a new and improved hydraulic pump assembly constructed in accordance with the principles and teachings of the present invention.

Referring now to the drawings, and more particularly to FIG. 1 thereof, there is shown an axial, longitudinally split cross-sectional view wherein the upper half of the drawing figure illustrates a conventional hydraulic pump assembly 10, while the lower half of the drawing figure illustrates a first embodiment of a new and improved hydraulic pump assembly 110, which is constructed in accordance with the teachings and principles of the present invention. Conventional hydraulic pump assembly 10 will be initially described in a brief manner, and subsequently, the first embodiment of new and improved hydraulic pump assembly 110 constructed in accordance with the principles and teachings of the present invention will then be described, and it is to be noted that the various component parts of hydraulic pump assemblies 10, 110 will be designated or denoted by similar or corresponding reference characters except that the reference characters for new and improved hydraulic pump assembly 110 of the present invention will be in the 100 series.

With reference thereof now being made to FIG. 1, conventional hydraulic pump assembly 10 is seen to include a cylinder block or barrel 12 defining an axis 13 and within which a plurality of piston cylinders 14 are arranged within a circumferential array about axis 13 for respectively housing or accommodating a plurality of pumping pistons, not shown. An inner peripheral region of cylinder block or barrel 12 is recessed as at 16, and accordingly a radially inwardly projecting shoulder portion 18 is defined at the swash plate end of cylinder block or barrel 12. An annular washer 19 is fixedly mounted upon an inner peripheral surface portion of cylinder block or barrel 12 adjacent the end of cylinder block or barrel 12 which is disposed opposite the swash plate end of cylinder block or barrel 12. A coil spring 20 is interposed between annular washer 19 and shoulder portion 18 of cylinder block or barrel 12 so as to bias, for example, pins, not shown, similar to those axially extending pins shown in U.S. Pat. No. 5,784,949, into engagement with shoe plate washer 22 such that shoe plate washer 22, in turn, biases the shoe plates, not shown, into engagement with the piston shoes, not shown, so as to secure the piston shoes upon the swash plate (also not shown). The inner periphery of shoulder portion 18 is provided with a plurality of axially extending splines defining a splined portion 24, and an input shaft 26, disposed substantially coaxially within cylinder block or barrel 12, has an external peripheral portion upon which there is likewise provided a plurality of axially extending splines defining a splined portion 28 by which input shaft 26 and cylinder barrel or block 12 are splinedly engaged together.

The operational and assembly disadvantages and drawbacks characteristic of the aforenoted hydraulic pump assembly 10 have been discussed hereinbefore, and accordingly a first embodiment of new and improved hydraulic pump assembly 110, constructed in accordance with the teachings and principles of the present invention, has been developed so as to address such disadvantages and drawbacks. More particularly, in a manner similar to that of the aforenoted hydraulic pump assembly 10, it is seen that the first embodiment of new and improved hydraulic pump assembly 110 of the present invention includes a cylinder block or barrel 112 defining an axis 113 and within which a plurality of piston cylinders 114 are defined and arranged within a circumferential array for respectively housing or accommodating a plurality of pumping pistons, not shown. An input shaft is disclosed at 126, and it is seen that the inner peripheral surface of cylinder block or barrel 112 is radially spaced from the outer peripheral surface of input shaft 126 so as to define an annular space 116 therebetween. An annular washer 119 is fixedly mounted upon an inner peripheral surface portion of cylinder block or barrel 112 which is adjacent to the end of cylinder block or barrel 112 which is disposed opposite the swash plate end of cylinder block or barrel 112, and a coil spring 120 is disposed within annular space 116 defined between the outer peripheral surface of input shaft 126 and the inner peripheral surface of cylinder block or barrel 112 with a first end of coil spring 120 being disposed in engagement with annular washer 119.

In accordance with the particularly unique feature of the first embodiment of the present invention, and in lieu of pins for engaging the shoe plate washer, which are similar to the axially extending pins as disclosed within U.S. Pat. No. 5,784,949, the first embodiment of the present invention includes an annular sleeve member 130 which is disposed within annular space 116 defined between the outer peripheral surface of input shaft 126 and the inner peripheral surface of cylinder block or barrel 112. Annular sleeve member 130 is also seen to be interposed between a second end of coil spring 120 and a shoe plate washer 122, whereby annular sleeve member 130, in a manner akin to the aforenoted pins which are similar to the axially extending pins of U.S. Pat. No. 5,784,949, is biased by coil spring 120 into engagement with shoe plate washer 122 such that shoe plate washer 122, in turn, biases the shoe plates, not shown, into engagement with the piston shoes, not shown, so as to secure the piston shoes upon the swash plate, also not shown.

The inner periphery of cylinder block or barrel 112 is provided with a plurality of axially extending splines defining a splined portion 124, and input shaft 126 has an external peripheral portion upon which there is likewise provided a plurality of axially extending splines defining a splined portion 128, however, it is seen that such splined regions or portions 124, 128, unlike corresponding splined regions or sections 24, 28 of hydraulic pump assembly 10, are not splined together. To the contrary, and in accordance with the unique feature of the present invention, it is seen that the inner peripheral surface of annular sleeve member 130 is provided with a plurality of axially extending splines defining a splined section 132 and the outer peripheral surface of annular sleeve member 130 is likewise provided with a plurality of axially extending splines defining a splined section 134. In this manner, inner peripheral splined section 132 of annular sleeve member 130 is adapted to be splinedly engaged with outer peripheral splined section 128 of input shaft 126, and outer peripheral splined section 134 of annular sleeve member 130 is adapted to be splinedly engaged with inner peripheral splined section 124 of cylinder block or barrel 112.

Figure 2:
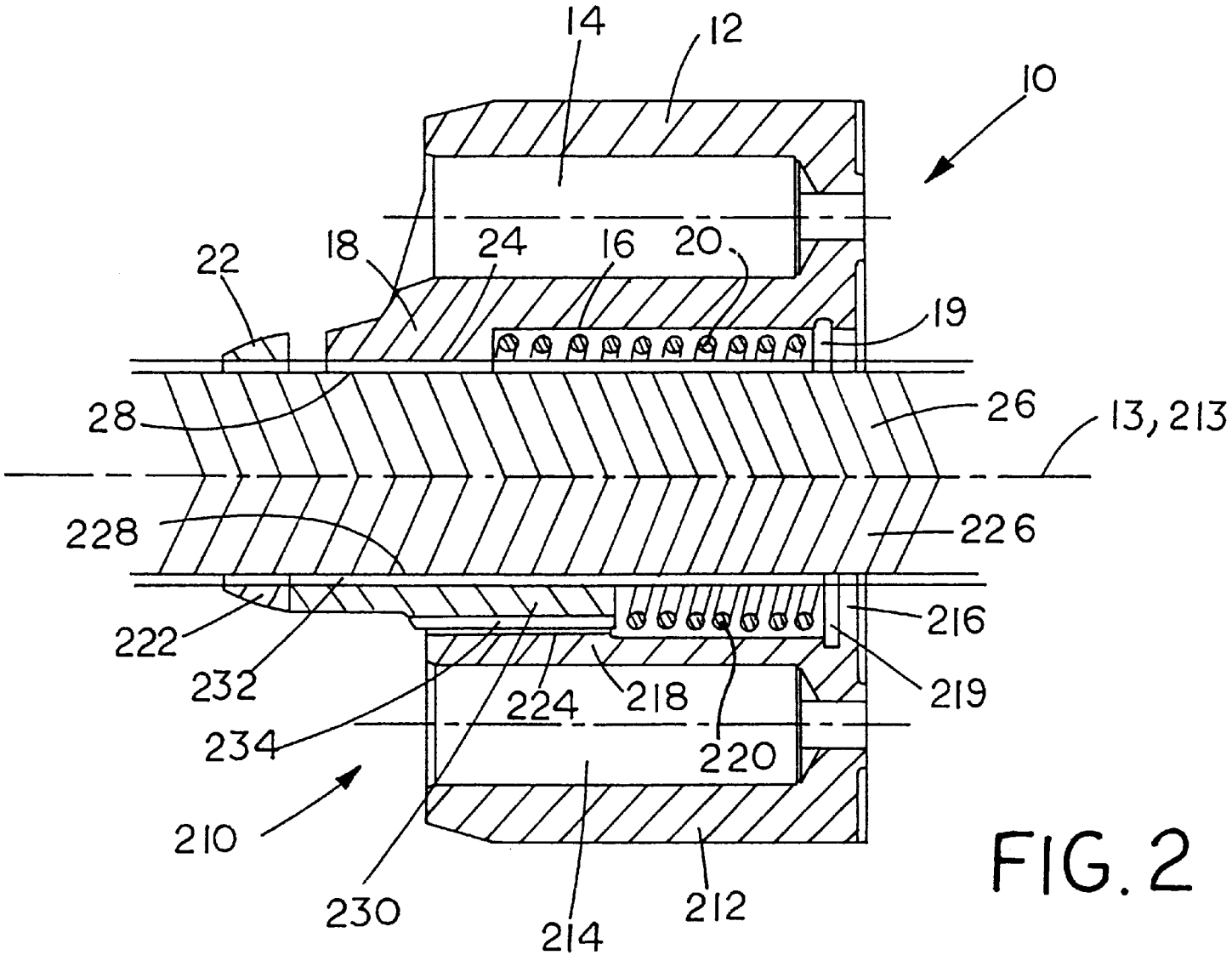
FIG. 2 is an axial, longitudinally split cross-sectional view similar to that of FIG. 1 partially showing, however, a conventional hydraulic pump assembly as compared to a second embodiment of a new and improved hydraulic pump assembly constructed in accordance with the principles and teachings of the present invention.

With reference now being made to FIG. 2, a second embodiment of a new and improved hydraulic pump assembly 210, constructed in accordance with the principles and teachings of the present invention, is disclosed and is compared to hydraulic pump assembly 10 in a manner similar to that set forth, disclosed, and illustrated in FIG. 1. As was the case with the description of the first embodiment of new and improved hydraulic pump assembly 110 as illustrated within FIG. 1, similar reference characters will be used to designate corresponding parts of hydraulic pump assemblies 10, 210. However, it is additionally noted that the component parts of second embodiment hydraulic pump assembly 210 of the present invention as illustrated within FIG. 2 will be designated by reference characters which are within the 200 series. Still further, a description of hydraulic pump assembly 10 will be omitted in conjunction with the description of second embodiment hydraulic pump assembly 210 of the present invention in view of the fact that hydraulic pump assembly 10 disclosed within the upper half of FIG. 2 is precisely the same as hydraulic pump assembly 10 as disclosed within the upper half of FIG. 1.

More particularly, then, with respect to second embodiment hydraulic pump assembly 210 of the present invention as disclosed within the lower half of FIG. 2, it is to be appreciated that the only significant difference between second embodiment hydraulic pump assembly 210 of the present invention as compared to first embodiment hydraulic pump assembly 110 of the present invention resides in the axial length of the axially extending splines defining outer peripheral splined section 234 of annular sleeve member 230, as well as the corresponding axial length of the axially extending splines defining inner peripheral splined section 224 of cylinder block or barrel 212. In a manner similar to that of hydraulic pump assembly 10, it is seen that the axially extending splines defining inner peripheral splined section 224 of cylinder block or barrel 212 are formed upon a radially inwardly projecting shouldered portion 218 similar to shouldered portion 18 of hydraulic pump assembly 10. It is appreciated that the axial extent or length of shouldered portion 218, and therefore the axial extent or length of inner peripheral splined portion 224 of cylinder block 212 is approximately one-half of the axial length or extent of cylinder block 212. In a similar manner, the axial extent or length of outer splined portion 234 of annular sleeve member 230 is approximately one-half the axial extent or length of annular sleeve member 230. It is, however, appreciated that other relative axial extents of inner splined portion 224 and/or outer splined portion 234 may prove useful. The remaining structure of second embodiment hydraulic pump assembly 210 is essentially the same as that of first embodiment hydraulic pump assembly 110, and therefore, further discussion of the structure and operative components of second embodiment hydraulic pump 210 will be omitted as not being necessary to the understanding and appreciation of the present invention hydraulic pump assembly.

INDUSTRIAL APPLICABILITY

It is thus to be appreciated that as a result of the construction and assembly of the first and second embodiments of the hydraulic pump assemblies 110 and 210 of the present invention, various operational and assembly advantages are achieved as compared to hydraulic pump assembly 10. By respectively incorporating the annular sleeve members 130, 230 within the first and second embodiments of hydraulic pump assemblies 110, 210 of the present invention, the tedious and time-consuming assembly procedures are effectively eliminated.

In addition, it is known in the art that the pumping action and movement of the swash plate relative to the cylinder block or barrel creates forces and moments which tend to cause misalignment or skewing of the various component parts with respect to each other. These operational movements, in turn, tend to cause excessive wear upon the pin elements of hydraulic pump assembly 10. To the contrary, however, with the respective interdisposition of annular sleeve members 130, 230 between input shafts 126, 226 and cylinder blocks or barrels 112, 212, and the resulting formation or creation of the double or dual spline engagement system defined by splined sections 128, 132 and 124, 134, and 228, 232 and 224, 234, respectively, upon input shafts 126, 226 and annular sleeve members 130, 230, as well as upon annular sleeve members 130, 230 and cylinder blocks or barrels 112, 212, in accordance with either one of the first and second embodiments of hydraulic pump assemblies 110, 210 of the present invention, such excessive wear problems are effectively eliminated or at least substantially reduced. This is due to the fact that with the double or dual spline engagement system, two sets of engaged splines can accommodate any such misalignment or skewing tendencies better than the single spline arrangement characteristic of system 10, or considered from a slightly different perspective, the presence of the double or dual spline engagement system permits such misalignment or skewing tendencies to be shared by or divided between the two splined systems.

It is lastly noted that there is also an operational or assembly advantage created by the second embodiment of hydraulic pump assembly 210, as shown in FIG. 2, as compared to the first embodiment of hydraulic pump assembly 110, as shown in FIG. 1. That is, as a result of the formation of shouldered portion 218 of cylinder block or barrel 212, coil spring 220 is able to be pre-set within annular space 216 prior to the assembly or insertion of annular sleeve member 230 within pump assembly 210. In other words, coil spring 220 can be inserted within annular space 216, and one end of coil spring 220 is engaged with annular washer member 219, and then coil spring 220 is then axially compressed such that the opposite end thereof is retained within annular space 216 as a result of axial engagement with shouldered portion 218 of cylinder block or barrel 212. Annular sleeve member 230 may then be readily and easily inserted into annular space 216 while being splinedly engaged with splined shoulder portion 218 of cylinder block or barrel 212. In connection with the assembly of the first embodiment of hydraulic pump assembly 110, as shown in FIG. 1, insertion of annular sleeve member 130 into annular space 116 and the splined connection with cylinder block or barrel 112 must be achieved while simultaneously axially compressing coil spring member 120.

Other aspects, objects and advantages of this invention can be obtained from a study of the drawings, the disclosure and the appended claims.

What is claimed is:

1. A hydraulic pump assembly, comprising:

a cylinder block defining an axis and having an inner peripheral splined portion;

a plurality of piston cylinders defined within said cylinder block and arranged within a circumferential array about said axis of said cylinder block for respectively housing a plurality of pumping pistons;

an input shaft having an axial extent and disposed substantially coaxially within said cylinder block, said input shaft having an outer peripheral splined portion;

a coil spring disposed around said input shaft at a first axial position thereof;

a shoe plate washer disposed around said input shaft at a second axial position thereof for biasing shoe plates into engagement with swashplate shoes; and an annular sleeve member disposed around said input shaft and axially interposed between said coil spring and said shoe plate washer such that said coil spring axially biases said annular sleeve member into engagement with said shoe plate washer, said annular sleeve member having an inner peripheral splined portion for splined engagement with said outer peripheral splined portion of said input shaft and an outer peripheral splined portion for splined engagement with said inner peripheral splined portion of said cylinder block said inner peripheral splined portion of said annular sleeve member being both radially within and at least partially coincident in an axial direction of said annular sleeve member with said outer peripheral splined portion of said annular sleeve member.

2. The pump assembly as set forth in claim 1, further including a washer fixedly mounted upon an inner peripheral surface portion of said cylinder block for supporting a first end of said coil spring.

3. The pump assembly as set forth in claim 2, further including:

a shouldered portion defined upon an inner peripheral portion of said cylinder block for engaging a second end of said coil spring.

4. The pump assembly as set forth in claim 3, wherein:

said inner peripheral splined portion of said cylinder block is formed upon said shouldered portion of said cylinder block.

5. The pump assembly as set forth in claim 4, wherein:

the axial extent of said shouldered portion upon which said inner peripheral splined portion of said cylinder block is formed is approximately one-half the axial extent of said cylinder block.

6. The pump assembly as set forth in claim 5, wherein:

the axial extent of said outer peripheral splined portion of said annular sleeve member is approximately one-half the extent of said annular sleeve member.

7. In a hydraulic pump assembly including a cylinder block having an inner peripheral splined portion and a plurality of piston cylinders for accommodating a plurality of pumping pistons, and an input shaft coaxially disposed with respect to the cylinder block and having an outer peripheral splined portion, a connection system for connecting the cylinder block and the input shaft together, comprising:

an annular sleeve member defined about an axis and adapted for disposition around the input shaft and within the cylinder block so as to be radially interposed between the input shaft and the cylinder block, said annular sleeve member having an axially extending inner peripheral splined portion and an axially extending outer peripheral splined portion for respectively defining a dual splined engagement system with the outer peripheral splined portion of the input shaft and with the inner peripheral splined portion of the cylinder block, said inner peripheral splined portion of said annular sleeve member being both radially within and at least partially coincident in an axial direction of said annular sleeve member with said outer peripheral splined portion of said annular sleeve member.

8. The pump assembly as set forth in claim 7, wherein:

an axial extent of said outer peripheral splined portion of said annular sleeve member is approximately one-half an axial extent of said annular sleeve member.

* * * * *